US012313086B1

(12) United States Patent
Dai et al.

(10) Patent No.: US 12,313,086 B1
(45) Date of Patent: May 27, 2025

(54) MOUNTING AND DEMOUNTING STRUCTURE AND FAN

(71) Applicant: Shenzhen Hesung Innovation Technology Co., LTD, Guangdong (CN)

(72) Inventors: Xianglu Dai, Guangdong (CN); Jie Feng, Guangdong (CN); Aimin He, Guangdong (CN)

(73) Assignee: Shenzhen Hesung Innovation Technology Co., LTD, Shenzhen (CN)

( * ) Notice: Subject to any disclaimer, the term of this patent is extended or adjusted under 35 U.S.C. 154(b) by 0 days.

(21) Appl. No.: 18/783,389

(22) Filed: Jul. 24, 2024

(30) Foreign Application Priority Data

Jan. 15, 2024 (CN) ..... 202410055671.1

(51) Int. Cl.
*F04D 29/64* (2006.01)
*F04D 19/00* (2006.01)

(52) U.S. Cl.
CPC ..... *F04D 29/646* (2013.01); *F04D 19/002* (2013.01)

(58) Field of Classification Search
CPC ..... F04D 29/325; F04D 29/34; F04D 29/388
See application file for complete search history.

(56) References Cited

U.S. PATENT DOCUMENTS

2023/0111026 A1 4/2023 Wang

FOREIGN PATENT DOCUMENTS

| | | | |
|---|---|---|---|
| AU | 2018247367 | A1 * | 4/2020 |
| CN | 207568383 | U | 7/2018 |
| CN | 211289333 | U | 8/2020 |
| CN | 213008587 | U | 4/2021 |
| CN | 220319904 | U | 1/2024 |

OTHER PUBLICATIONS

Notice of Grant dated Jul. 15, 2024 from corresponding CN Application No. 202410055671.1.

* cited by examiner

*Primary Examiner* — Brian O Peters
(74) *Attorney, Agent, or Firm* — ArentFox Schiff LLP

(57) ABSTRACT

A mounting and demounting structure includes a blade hub and multiple fan blades. Multiple mounting seats are disposed on the blade hub along a circumferential direction of the blade hub. The multiple fan blades are connected to the multiple mounting seats respectively. A locking leaf is rotatably connected to each mounting seat. The locking leaf is in a locked state of engaging with the each mounting seat and an unlocked state of disengaging from the each mounting seat.

18 Claims, 5 Drawing Sheets

MOUNTING AND DEMOUNTING STRUCTURE AND FAN

CROSS-REFERENCE TO RELATED APPLICATION(S)

This application claims priority to Chinese Patent Application No. 202410055671.1 filed Jan. 15, 2024, the disclosure of which is incorporated herein by reference in its entirety.

TECHNICAL FIELD

The present disclosure relates to the technical field of mounting and demounting devices for fan blades and, in particular, to a mounting and demounting structure and a fan

BACKGROUND

A fan is a commonly used electric appliance that accelerates the circulation of air by using an electric motor to drive fan blades to rotate, mainly used for cooling down and circulating the air and widely applied in various places in life. Most fan blades are mounted and secured through bolts. During assembly, multiple bolts are required to be screwed, which consumes time and energy and has a very low efficiency. Moreover, when maintenance or cleaning is required later, the bolts are required to be unscrewed to take the fan blades down, causing great inconvenience. If the fan is mounted to a high position such as the ceiling, a ladder is also required for this operation, so an operator's safety cannot be guaranteed.

In some quick-mounting structures disclosed in the related art, quick fasteners engaging with fan blade insertion assemblies are disposed on fan turntable bodies. During mounting, only fan blades are required to be inserted into the quick fasteners for engagement. When the fan blades are required to be demounted, pressing portions on the quick fasteners are pushed to release the fan blades. However, when fans using the preceding quick mounting structures are used, fan blades are prone to shake, so the stability and safety of the fan blades cannot be ensured.

SUMMARY

The present disclosure provides a mounting and demounting structure and a fan to quickly mount and demount fan blades and ensure the stability of the fan blades during use.

In an aspect, a mounting and demounting structure is provided. The mounting and demounting structure includes a blade hub and a plurality of fan blades. A plurality of mounting seats are disposed on the blade hub along a circumferential direction of the blade hub. The plurality of mounting seats are connected to the plurality of fan blades respectively.

An insertion assembly is disposed on each of the plurality of fan blades, and each of the plurality of mounting seats is provided with an insertion cavity, where the insertion assembly is provided with a resilient limiting member, each of the plurality of mounting seats is provided with a first limiting hole communicating with the insertion cavity, the insertion assembly is inserted into the insertion cavity, and the resilient limiting member has a state where the insertion assembly engages with the first limiting hole and a state where the insertion assembly disengages from the first limiting hole.

Each of the plurality of mounting seats is rotatably connected to a locking leaf, where the locking leaf has a locked state where the locking leaf engages with a corresponding mounting seat and an unlocked state where the locking leaf disengages from the each of the plurality of mounting seats, a locking tab protrudes from one side of the locking leaf facing the each of the plurality of mounting seats, the each of the plurality of mounting seats is provided with a fixing hole, each of the plurality of fan blades is provided with a anti-detachment hole, and when the locking leaf is in the locked state, the locking tab passes through the fixing hole and engages with the anti-detachment hole.

In another aspect, a fan is provided. The fan includes a mounting base and the preceding mounting and demounting structure. The mounting and demounting structure is mounted to the mounting base, and a locking leaf is configured to rotate upward or downward relative to a corresponding mounting seat so as to be switched to the unlocked state.

REFERENCE LIST

Figure 1:
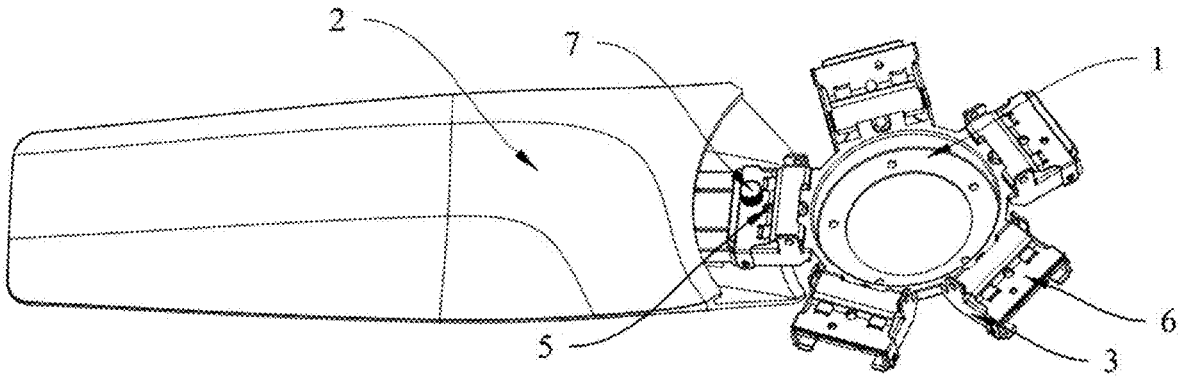
FIG. 1 is a view illustrating the structure of a quick mounting and demounting structure according to the present disclosure.

1 blade hub
- 2 fan blade
  - 21 anti-detachment hole
- 3 mounting seat
  - 31 insertion cavity
  - 32 first limiting hole
  - 33 fixing hole
  - 34 bypassing groove
  - 35 second limiting hole
  - 36 guide plate
  - 37 second fastening hole
  - 38 convex closure
- 4 insertion assembly
  - 41 first plate
    - 411 first limiting groove
    - 412 first connection hole
    - 413 first fastening hole
  - 42 second plate
    - 421 second limiting groove
    - 422 second connection hole
  - 43 first limiting plate
- 5 resilient limiting member
  - 51 resilient portion
    - 511 first straight plate
    - 512 second straight plate
    - 513 first connection plate
    - 514 engagement portion

52 limiting portion
6 locking leaf
61 locking tab
62 resilient sheet
621 first bent portion
622 second bent portion
63 connection ear
64 second limiting plate
65 rotation plate
651 third plate
652 fourth plate
66 limiting protrusion
67 cutout
68 avoidance hole
69 third fastening hole
7 locking member

DETAILED DESCRIPTION

The present disclosure is further described hereinafter in detail in conjunction with drawings and embodiments. It is to be understood that the specific embodiments set forth below are intended to illustrate and not to limit the present disclosure. In addition, it is to be noted that for ease of description, only part, not all, of the structures related to the present disclosure are illustrated in the drawings.

In the description of the present disclosure, unless otherwise expressly specified and limited, the term "connected to each other", "connected" or "secured" is to be construed in a broad sense, for example, as securely connected, detachably connected or integrated; mechanically connected or electrically connected; directly connected to each other or indirectly connected to each other via an intermediary; or internal connection between two components or an interaction relation between two components. For those of ordinary skill in the art, specific meanings of the preceding terms in the present disclosure may be construed based on specific situations.

In the present disclosure, unless otherwise expressly specified and limited, when a first feature is described as "above" or "below" a second feature, the first feature and the second feature may be in direct contact or be in contact via another feature between the two features. Moreover, when the first feature is described as "on", "above", or "over" the second feature, the first feature is right on, above, or over the second feature, the first feature is obliquely on, above, or over the second feature, or the first feature is simply at a higher level than the second feature. When the first feature is described as "under", "below", or "underneath" the second feature, the first feature is right under, below, or underneath the second feature, the first feature is obliquely under, below, or underneath the second feature, or the first feature is simply at a lower level than the second feature.

In the description of this embodiment, the orientation or position relationships indicated by terms such as "above", "below" and "right" are based on the orientation or position relationships shown in the drawings. These orientations or position relationships are only for ease of description and simplifying an operation and do not indicate or imply that the referred device or element must have a specific orientation and is constructed and operated in a specific orientation. Thus, these orientations or position relationships are not to be construed as limiting the present disclosure. In addition, the terms "first" and "second" are only used for distinguishing between descriptions and have no special meanings.

The technical solutions of the present disclosure are further described hereinafter in conjunction with the drawings and the embodiments.

Figure 2:
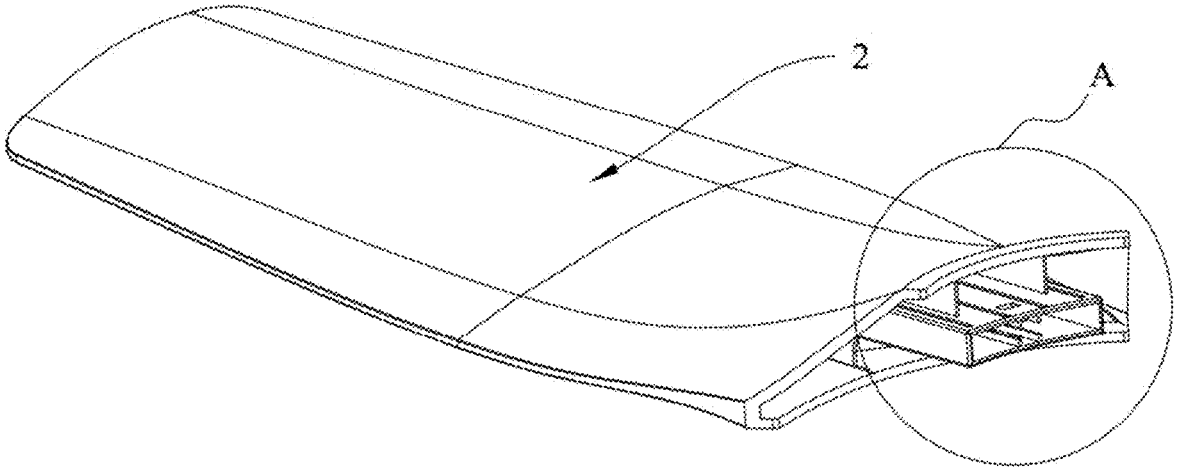
FIG. 2 is view one illustrating the partial structure of a fan blade according to the present disclosure.
Figure 3:
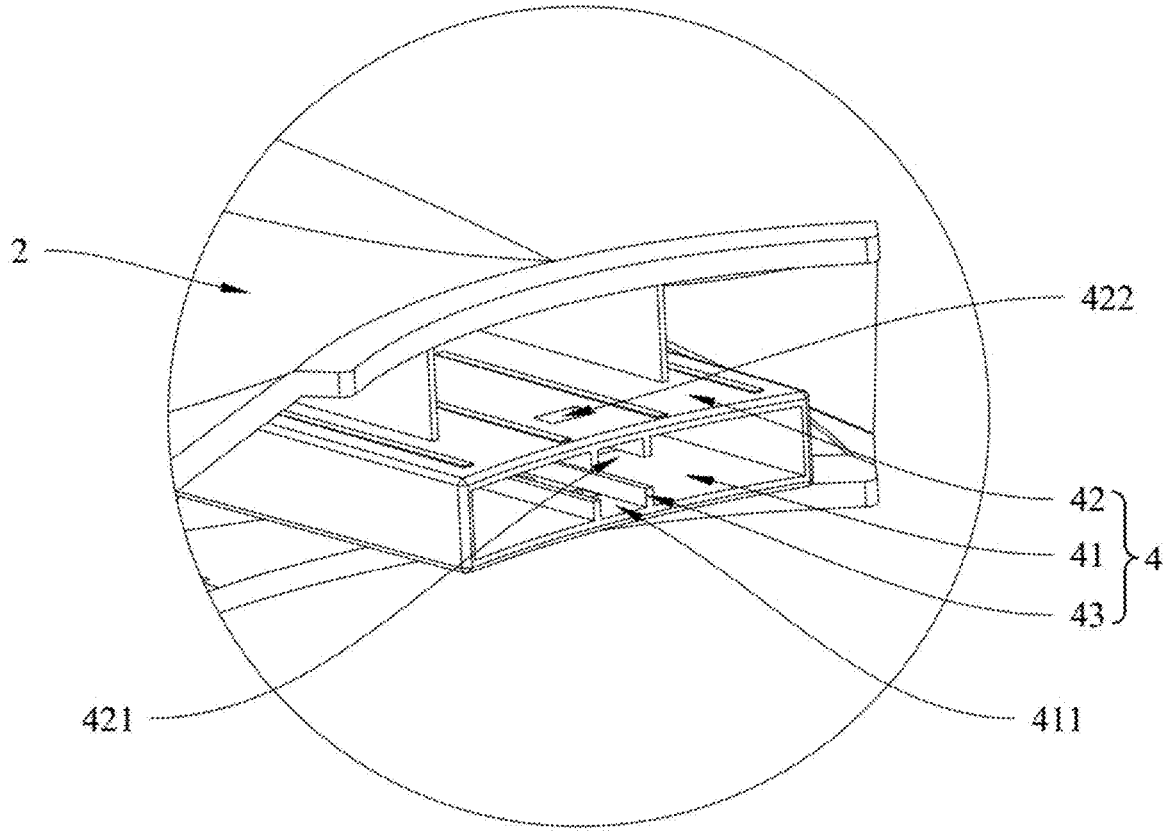
FIG. 3 is a partial enlarged view of part A of FIG. 2.
Figure 4:
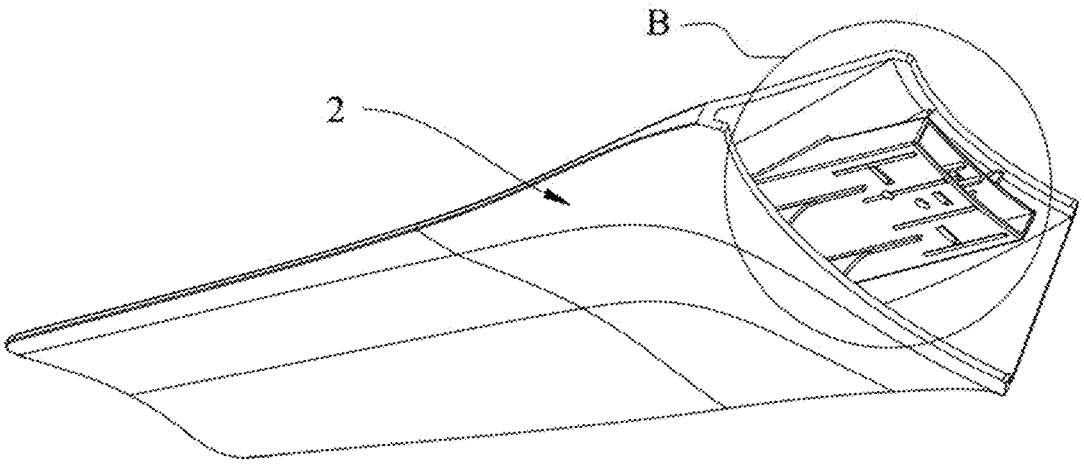
FIG. 4 is view two illustrating the partial structure of a fan blade according to the present disclosure.
Figure 7:
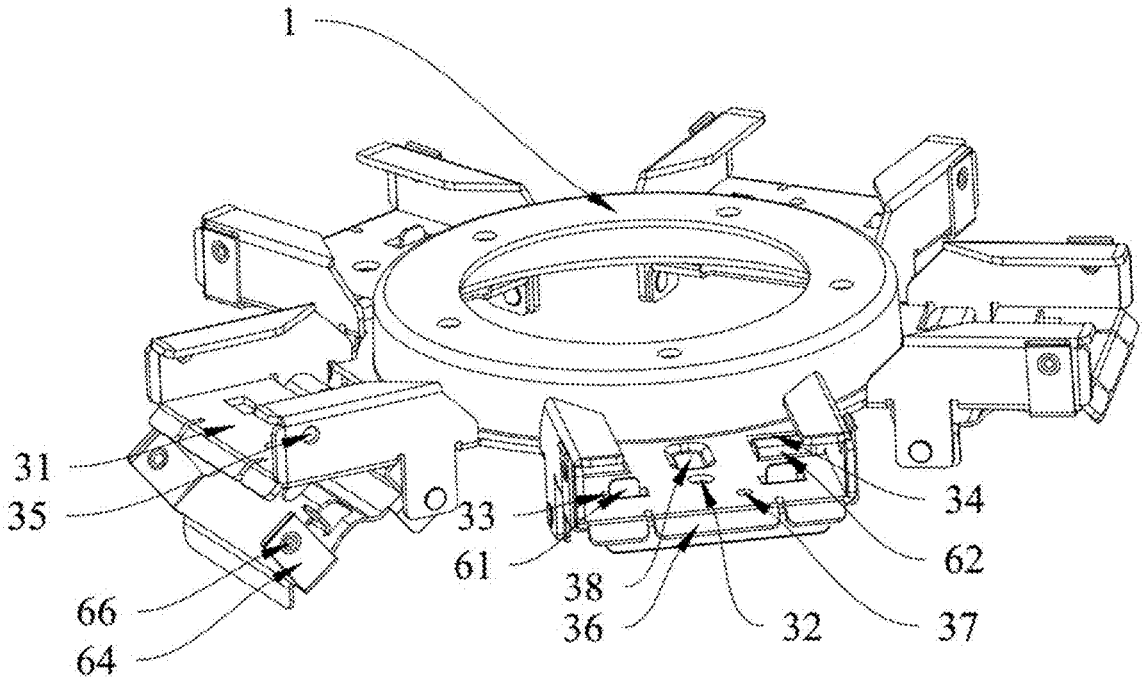
FIG. 7 is a view illustrating the structure of a quick mounting and demounting structure without fan blades mounted according to the present disclosure.
Figure 8:
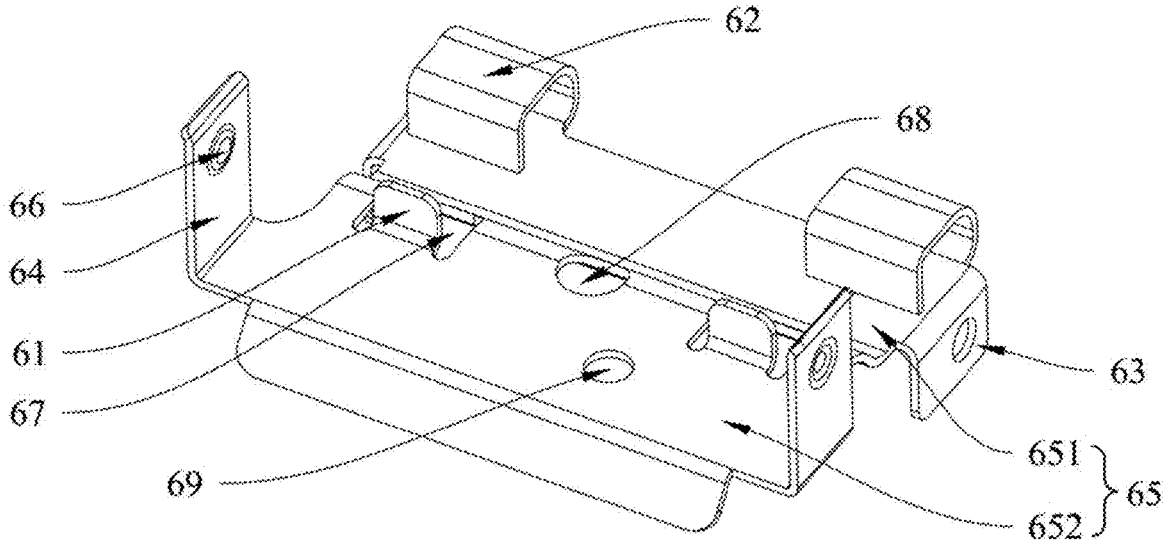
FIG. 8 is a view illustrating the structure of a locking leaf according to the present disclosure.
Figure 9:
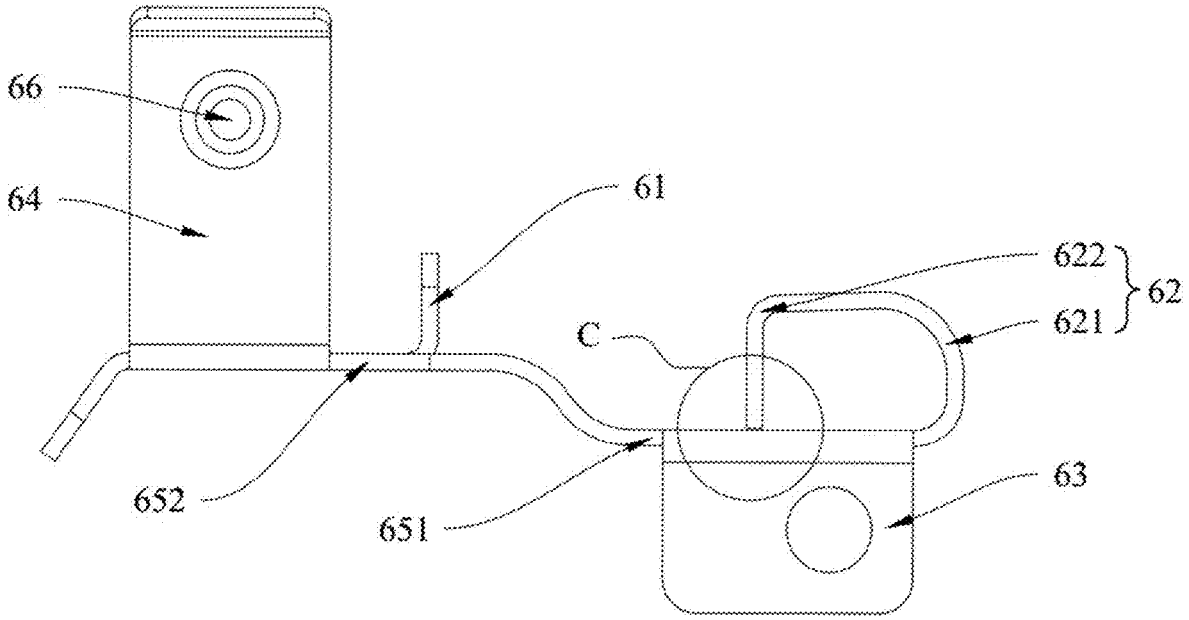
FIG. 9 is a side view of a locking leaf according to the present disclosure.

As shown in FIG. 1, the present disclosure provides a quick mounting and demounting structure. The mounting and demounting structure includes a blade hub 1 and multiple fan blades 2. Multiple mounting seats 3 are disposed on the blade hub 1 along a circumferential direction of the blade hub 1. The multiple fan blades 2 are connected to the multiple mounting seats 3 respectively. A locking leaf 6 is rotatably connected to each mounting seat 3. The locking leaf 6 has a locked state where the locking leaf 6 engages with the mounting seat 3 and an unlocked state where the locking leaf 6 disengages from the mounting seat 3. Referring to FIGS. 7, 8 and 9, a locking tab 61 protrudes from one side of the locking leaf 6 facing the mounting seat 3, and a fixing hole 33 is disposed on the mounting seat 3. In conjunction with FIGS. 4 and 5, a anti-detachment hole 21 is disposed on a fan blade 2, and when the locking leaf 6 is in the locked state, the locking tab 61 passes through the fixing hole 33 and engages with the anti-detachment hole 21. Referring to FIGS. 2, 3 and 7, an insertion assembly 4 is disposed on each fan blade 2, and a corresponding insertion cavity 31 is disposed on a respective mounting seat 3. A resilient limiting member 5 is disposed on the insertion assembly 4. A first limiting hole 32 communicating with the insertion cavity 31 is disposed on the respective mounting seat 3. The insertion assembly 4 is inserted into the insertion cavity 31. The resilient limiting member 5 has a state where the resilient limiting member 5 engages with and where the resilient limiting member 5 disengages from the first limiting hole 32.

When the respective fan blade 2 is mounted, the locking leaf 6 is first enabled to be in the unlocked state, and then the respective fan blade 2 is inserted into the insertion cavity 31 of the each mounting seat 3 through an insertion assembly 4. After the insertion is performed in position, a resilient limiting member 5 engages with the first limiting hole 32, and under the effect of a resilient force of the resilient limiting member 5, an operator is provided with a tactile feedback to further determine whether the respective fan blade 2 is mounted in position to initially mount the respective fan blade 2. Subsequently, the locking leaf 6 is switched to the locked state of engaging with the each mounting seat 3 so that the locking tab 61 can engage with a anti-detachment hole 21 of the respective fan blade 2, preventing the respective fan blade 2 from shaking and falling off during use and ensuring that the respective fan blade 2 can be mounted tightly. When the respective fan blade 2 requires demounting for maintenance later, only the locking leaf 6 is required to be switched to the unlocked state to make the locking tab 61 move out of the anti-detachment hole 21, and then the resilient limiting member 5 within the first limiting hole 32 is moved out, and the respective fan blade 2 is pulled out from the insertion cavity 31. In this manner, the demounting is completed. This operation is simple and convenient and saves time and energy, facilitating the improvement in the operation efficiency.

Specifically, in this embodiment, five mounting seats 3 are disposed on the blade hub 1. The number of mounting seats 3 may be set according to requirements in other embodiments.

Figure 5:
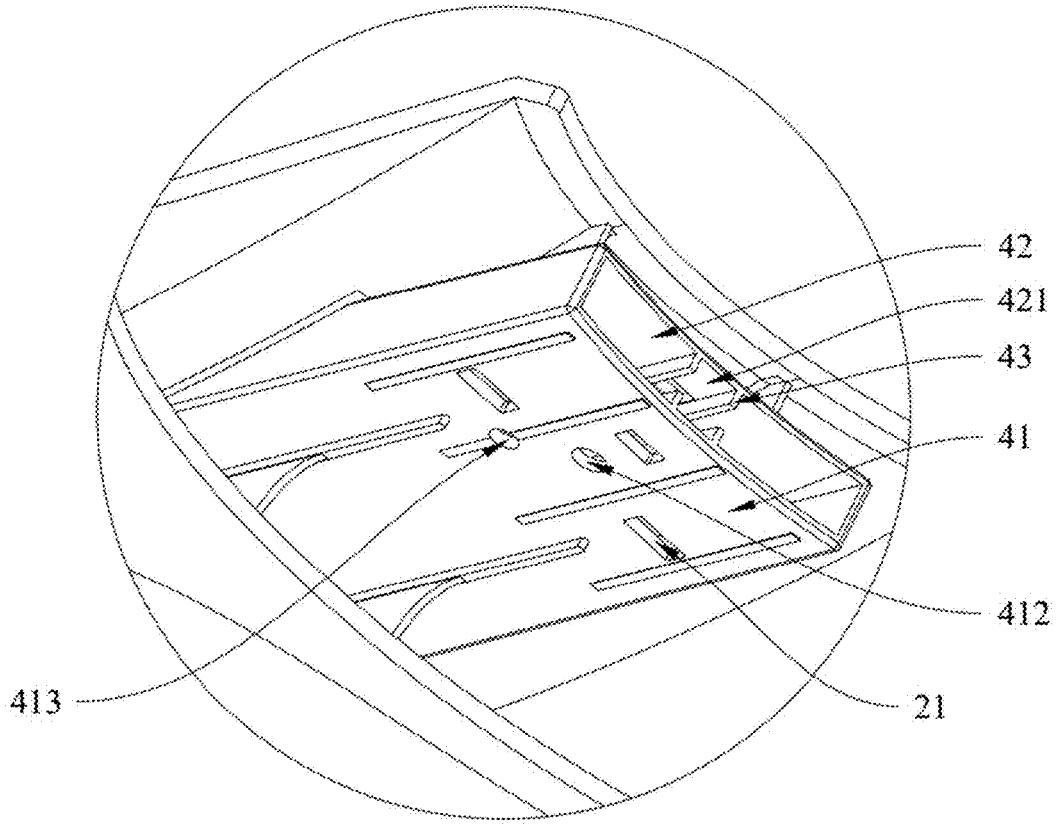
FIG. 5 is a partial enlarged view of part B of FIG. 4.
Figure 6:
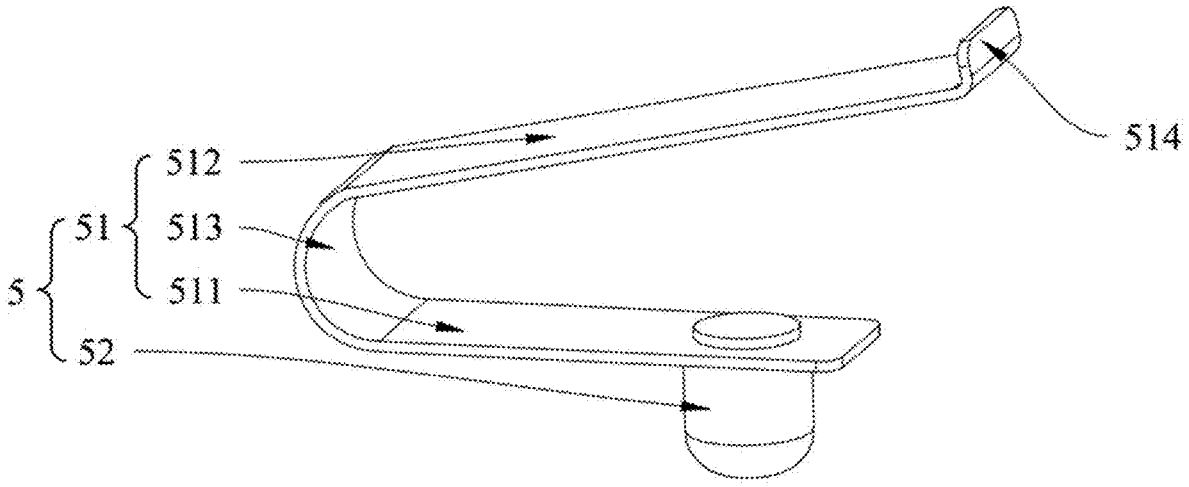
FIG. 6 is a view illustrating the structure of a resilient limiting member according to the present disclosure.

Optionally, as shown in FIGS. 2 to 5, the insertion assembly 4 includes a first plate 41 and a second plate 42 that are spaced apart. The first plate 41 is connected to the second plate 42 through two side plates. The first plate 41, the second plate 42 and the two side plates form a structure whose cross section is rectangular and whose interior is a cavity. The first plate 41, the second plate 42 and the two side plates can be inserted into the insertion cavity 31. Two first limiting plates 43 protrude from one side of the first plate 41 and one side of the second plate 42, where the two first limiting plates 43 are spaced apart, and the side of the first plate 41 and the side of the second plate 42 face each other. The two first limiting plates 43 on the first plate 41 are enclosed to form a first limiting groove 411. The two first limiting plates 43 on the second plate 42 are enclosed to form a second limiting groove 421. A first connection hole 412 is disposed on the bottom wall of the first limiting groove 411. Referring to FIG. 6, the resilient limiting member 5 includes a resilient portion 51 and a limiting portion 52. The resilient portion 51 is connected to the limiting portion 52. The resilient portion 52 engages with the first limiting groove 411 and the second limiting groove 421 and extends out of the first connection hole 412 through the limiting portion 52 to secure the resilient limiting member 5 to the insertion assembly 4. When the respective fan blade 2 is mounted, the limiting portion 52 extending out of the first connection hole 412 engages with the first limiting hole 32 so that the respective fan blade 2 can be securely connected to the each mounting seat 3. Moreover, the first plate 41 and the second plate 42 abut against two opposite sidewalls of the insertion cavity 31, and the two side plates abut against other two sidewalls of the insertion cavity 31. When the insertion assembly 4 slides to be inserted into the insertion cavity 31, the limiting portion 52 slides into the insertion cavity 31 along a guide plate 36. During the sliding process, the limiting portion 52 is lifted gradually and squeezes the cavity wall of the insertion cavity 31 to cause resilient deformation. When the limiting portion 52 moves to face the first limiting hole 32, the limiting portion 52 instantly extends into the first connection hole 412 and engages with the first limiting hole 32, and the resilient portion 51 resumes the resilient deformation. During the process of resuming the deformation, the resilient portion 51 generates vibration. The vibration is transmitted to the operator's hand to provide the tactile feedback so that the operator can apparently learn that the respective fan blade 2 has been mounted in position. This operation is simple and convenient, and the mounting stability of the respective fan blade 2 can also be ensured.

Further, in this embodiment, as shown in FIG. 6, the resilient portion 51 includes a first straight plate 511, a second straight plate 512 and a first connection plate 513. The first straight plate 511 is opposite to the second straight plate 512 and connected to the second straight plate 512 through the first connection plate 513. The limiting portion 52 protrudes from one side of the first straight plate 511 facing away from the second straight plate 512. One end of the second straight plate 512 facing away from the first connection plate 513 is provided with an engagement portion 514. The engagement portion 514 extends in a direction away from the second straight plate 512. As shown in FIGS. 2 and 3, a second connection hole 422 is disposed on the bottom wall of the second limiting groove 421, the second straight plate 512 abuts against the bottom wall of the second limiting groove 421, and the engagement portion 514 is lodged in the second connection hole 422 to improve the stability of the resilient limiting member 5.

In other embodiments, the resilient portion 51 of the resilient limiting member 5 may also be in the form of another structure. For example, the resilient portion 51 is a spring. A first end of the spring is secured to the bottom wall of the second limiting groove 421 while a second end of the spring is connected to the preceding limiting portion 52. As long as the resilient portion 51 can supply a resilient force to the limiting portion 52, the limiting portion 52 can be enabled to be in the state of engaging with or disengaging from the first limiting hole 32.

Optionally, as shown in FIGS. 7 and 8, one side of the locking leaf 6 facing the each mounting seat 3 is provided with a resilient sheet 62, and a bypassing groove 34 for avoiding the resilient sheet 62 is formed on the each mounting seat 3. When the locking leaf 6 is in the locked state, the resilient sheet 62 passes through the bypassing groove 34 and presses against the respective fan blade 2 so that the stability of the respective fan blade 2 after mounting can be further enhanced, and the respective fan blade 2 can be prevented from relatively sliding during the rotation process.

Specifically, in this embodiment, as shown in FIG. 8, an avoidance hole 68 is also disposed on the locking leaf 6. When the locking leaf 6 is in the locked state, the avoidance hole 68 is used for avoiding the engagement portion 52 that engages with the first limiting hole 32 to avoid interference between the limiting portion 52 and the locking leaf 6.

Figure 10:
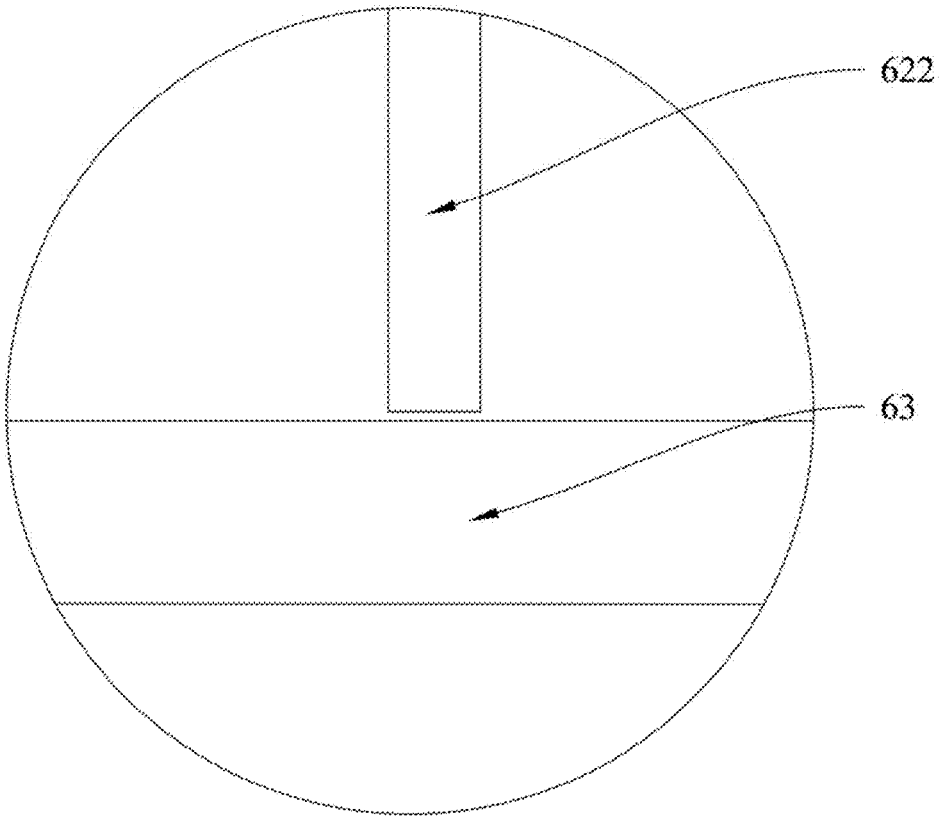
FIG. 10 is a partial enlarged view of part C of FIG. 9.

Further, referring to FIGS. 8 to 10, the locking leaf 6 includes two connection ears 63, two second limiting plates 64 and a rotation plate 65. The two connection ears 63 are opposite at a first end of the rotation plate 65 and rotatably connected to the each mounting seat 3. The two second limiting plates 64 are opposite at a second end of the rotation plate 65. When the locking leaf 6 is in the locked state, the two second limiting plates 64 are stacked on two opposite sides of the each mounting seat 3 respectively. A limiting protrusion 66 is disposed on one of the two second limiting plates 64 or the each mounting seat 3 while a second limiting hole 35 is disposed on the other one of the two second limiting plates 64 or the each mounting seat 3. When the locking leaf 6 is in the locked state, the limiting protrusion 66 engages with the second limiting hole 35 so that the engagement stability of the locking leaf 6 and the each mounting seat 3 can be ensured, thereby ensuring the mounting stability of the respective fan blade 2.

Specifically, in this embodiment, the locking leaf 6 is disposed on a lower side of the each mounting seat 3, limiting protrusions 66 are disposed on the two second limiting plates 64, and second limiting holes 35 are disposed on the each mounting seat 3. The limiting protrusions 66 engage with the second limiting holes 35 respectively so that the locking leaf 6 can also be prevented from being switched to the unlocked state under the effect of gravity. Furthermore, with continued reference to FIGS. 8 to 10, the locking leaf 6 is integrally formed, a cutout 67 is disposed on the locking leaf 6, and the locking tab 61 is bent out from the cutout 67. This has a good connection strength and can save material costs. As shown in FIGS. 9 and 10, the resilient sheet 62 includes a first bent portion 621 and a second bent portion 622. The first bent portion 621 is bent from and connected to one side of the rotation plate 65 facing the each mounting seat 3. The second bent portion 622 is connected to one end of the first bent portion 621 facing away from the locking leaf 6. The second bent portion 622 is bent toward the rotation plate 65. A clearance is present between the second bent portion 622 and the rotation plate 65. Referring to FIG. 10, the clearance is a clearance when the locking leaf 6 is in the locked state. When the locking leaf 6 is in the unlocked state, the clearance is larger so that the resilient sheet 62 can have a certain amount of resilient movement. When the locking leaf 6 is in the locked state, under the resilient effect of the resilient sheet 62, the stability of the resilient sheet 62 pressing against the respective fan blade 2 can be ensured, and the respective fan blade 2 can be prevented from loosening.

In this embodiment, two locking tabs 61 are spaced apart on the locking leaf 6 to improve the stability of engaging with the respective fan blade 2. Two resilient sheets 62 are also spaced apart on the locking leaf 6 so that the force applied to the respective fan blade 2 can be more uniform.

Further, as shown in FIG. 9, the rotation plate 65 includes a third plate 651 and a fourth plate 652. The third plate 651 is bent from and connected to the fourth plate 652. The fourth plate 652 is bonded to the each mounting seat 3. The two connection ears 63 and the two resilient sheets 62 are disposed on the third plate 651. The two second limiting plates 64 and the two locking tabs 61 are disposed on the fourth plate 652.

Specifically, in this embodiment, as shown in FIG. 7, the each mounting seat 3 and the blade hub 1 are integrally formed, one end of the each mounting seat 3 facing the respective fan blade 2 has a C-shaped cross section, and the preceding insertion cavity 31 is formed by enclosing. Two fixing plates protrude from one side of the each mounting seat 3 facing the blade hub 1, are disposed on two sides of the each mounting seat 3 respectively and are stacked in one-to-one correspondence with the two connection ears 63. A fastener passes through the two connection ears 63 and the two fixing plates sequentially to rotatably connect the locking leaf 6 to the two fixing plates. A convex closure 38 is also disposed between two bypassing grooves 34 disposed on a fixing seat to strengthen the connection strength of the fixing seat.

Exemplarily, the fastener is a bolt, a nut, a pin, or a rivet that is commonly used in the art. This is not specifically limited herein.

Optionally, as shown in FIG. 1, the mounting and demounting structure further includes a locking member 7. Referring to FIG. 5, a first fastening hole 413 is disposed on the first plate 41. Referring to FIGS. 7 and 8, a second fastening hole 37 is disposed on the fixing seat, and a third fastening hole 69 is disposed on the locking leaf 6. The locking member 7 passes through the third fastening hole 69, the second fastening hole 37 and the first fastening hole 413 sequentially to securely connect the respective fan blade 2 to the locking leaf 6 and the each mounting seat 3 so that the securing stability of the respective fan blade 2 can be further enhanced, and the respective fan blade 2 can be prevented from sliding out of the insertion cavity 31.

Exemplarily, the locking member 7 is also a bolt or a screw that is commonly used in the art.

Optionally, as shown in FIG. 7, the inlet edge of the insertion cavity 31 is provided with the guide plate 36, and the guide plate 36 extends in a direction away from the insertion cavity 31 to facilitate the insertion of the insertion assembly 4, thereby having a certain guide effect. Specifically, in this embodiment, the periphery of the insertion cavity 31 is provided with guide plates 36. Correspondingly, a flange is disposed on the locking leaf 6 to be adapted to the bonding between the locking leaf 6 and the each mounting seat 3 so as to ensure the tightness of the bonding between the locking leaf 6 and the each mounting seat 3.

Specifically, as shown in FIG. 8, a guide portion is also disposed on each second limiting plate 64 and obliquely extends toward the outer side of the each second limiting plate 64 to provide a guide effect for buckling the locking leaf 6 and the each mounting seat 3.

This embodiment further provides a fan. The fan includes a mounting base and the preceding mounting and demounting structure. The mounting and demounting structure is mounted to the mounting base. The locking leaf 6 is rotated upward or downward relative to the each mounting seat 3 to be switched to the unlocked state of disengaging from the each mounting seat 3, that is, the locking leaf 6 is disposed above or below the each mounting seat 3.

In addition, a lamp (or another decorative structure) may be mounted to one side of the fan facing away from the mounting base to be assembled into a fan lamp. Exemplarily, when the locking leaf 6 is rotated downward relative to the each mounting seat 3 to be opened, if the locking leaf 6 does not engage with the each mounting seat 3 in position and is in the unlocked state (the limiting protrusions 66 do not engage with the second limiting holes 35) during the mounting of the lamp, the lamp cannot be mounted. This reminds the operator to engage the locking leaf 6 in position so that the mounting stability of the respective fan blade 2 can be ensured, and the safety of a user can be ensured.

The present disclosure provides a quick mounting and demounting structure. The mounting and demounting structure includes the blade hub and the plurality of fan blades. The plurality of mounting seats are disposed on the blade hub along the circumferential direction of the blade hub. The plurality of fan blades are connected to the plurality of mounting seats respectively. The locking leaf is rotatably connected to the each of the plurality of mounting seats. The locking leaf is in the locked state of engaging with the each of the plurality of mounting seats and the unlocked state of disengaging from the each of the plurality of mounting seats. The insertion assembly is disposed on the each of the plurality of fan blades. The corresponding insertion cavity is disposed on the respective one of the plurality of mounting seats. Before the respective one of the plurality of fan blades is mounted, the locking leaf is enabled to be in the unlocked state, the respective one of the plurality of fan blades is inserted into the insertion cavity of the each of the plurality of mounting seats through an insertion assembly, and a resilient limiting member engages with the first limiting hole to initially mount the respective one of the plurality of fan blades; and then the locking leaf is switched to the locked state of engaging with the each of the plurality of mounting seats so that the locking tab can engage with a anti-detachment hole of the respective one of the plurality of fan blades, preventing the respective one of the plurality of fan blades from shaking and falling off during use and ensuring that the respective one of the plurality of fan blades can be mounted tightly. In addition, the effect of a resilient force of the resilient limiting member may supply a tactile feedback to an operator to ensure that the respective one of the plurality of fan blades can be mounted in position. When the respective one of the plurality of fan blades requires demounting for maintenance later, only the locking leaf is required to be switched to the unlocked state to make the locking tab move out of the anti-detachment hole, and then the portion of the resilient limiting member that engages with the first limiting hole is moved out, and the respective one of the plurality of fan blades is pulled out from the insertion cavity. In this manner, the demounting is completed. This operation is simple and convenient, and the operation efficiency can be improved.

What is claimed is:

1. A mounting and demounting structure, comprising a blade hub and a plurality of fan blades, wherein a plurality of mounting seats are disposed on the blade hub along a circumferential direction of the blade hub, and the plurality of mounting seats are connected to the plurality of fan blades respectively;

wherein an insertion assembly is disposed on each of the plurality of fan blades, and each of the plurality of mounting seats is provided with an insertion cavity, wherein the insertion assembly is provided with a resilient limiting member, each of the plurality of mounting seats is provided with a first limiting hole communicating with the insertion cavity, the insertion assembly is inserted into the insertion cavity, and the resilient limiting member has a state where the insertion assembly engages with the first limiting hole and a state where the insertion assembly disengages from the first limiting hole; and wherein each of the plurality of mounting seats is rotatably connected to a locking leaf, wherein the locking leaf has a locked state where the locking leaf engages with a corresponding mounting seat and an unlocked state where the locking leaf disengages from a corresponding mounting seat, a locking tab protrudes from one side of the locking leaf facing the each of the plurality of mounting seats, the each of the plurality of mounting seats is provided with a fixing hole, each of the plurality of fan blades is provided with a anti-detachment hole, and when the locking leaf is in the locked state, the locking tab passes through the fixing hole and engages with the anti-detachment hole.

2. The mounting and demounting structure according to claim 1, wherein the insertion assembly comprises a first plate and a second plate that are spaced apart, wherein two first limiting plates that are spaced apart protrude from one side of the first plate facing the second plate to one side of the second plate, and two first limiting plates that are spaced apart protrude from one side of second plate facing the first plate to one side of the first plate, two first limiting plates on the first plate are enclosed to form a first limiting groove, two first limiting plates on the second plate are enclosed to form a second limiting groove, and the resilient limiting member comprises a resilient portion and a limiting portion connected to the resilient portion; and wherein a bottom wall of the first limiting groove is provided with a first connection hole, the resilient portion is lodged in the first limiting groove and the second limiting groove, the limiting portion extends out of the first connection hole and engages with the first limiting hole.

3. The mounting and demounting structure according to claim 2, wherein the resilient portion comprises a first straight plate, a second straight plate and a first connection plate, wherein the first straight plate is opposite to the second straight plate and connected to the second straight plate through the first connection plate, the limiting portion protrudes from one side of the first straight plate facing away from the second straight plate, one end of the second straight plate facing away from the first connection plate is provided with an engagement portion, a bottom wall of the second limiting groove is provided with a second connection hole, the second straight plate abuts against the bottom wall of the second limiting groove, and the engagement portion is lodged in the second connection hole.

4. The mounting and demounting structure according to claim 1, wherein one side of the locking leaf facing the each of the plurality of mounting seats is provided with a resilient sheet, and each of the plurality of mounting seats is provided with a bypassing groove for bypassing the resilient sheet; and when the locking leaf is in the locked state, the resilient sheet passes through the bypassing groove and presses against a respective one of the plurality of fan blades.

5. The mounting and demounting structure according to claim 4, wherein the locking leaf comprises two connection ears, two second limiting plates and a rotation plate, wherein the two connection ears are oppositely disposed at a first end of the rotation plate and are rotatably connected to a respective mounting seat, and the two second limiting plates are oppositely disposed at a second end of the rotation plate; and when the locking leaf is in the locked state, the two second limiting plates are respectively stacked on two opposite sides of a corresponding mounting seats, a limiting protrusion is disposed on one of one second limiting plate and a corresponding one of the plurality of mounting seats, and a second limiting hole is disposed on another one of the one second limiting plate and the corresponding one of the plurality of mounting seats, wherein the limiting protrusion engages with the second limiting hole.

6. The mounting and demounting structure according to claim 5, wherein the locking leaf is provided with a cutout, and the locking tab is bent out from the cutout; and the resilient sheet comprises a first bent portion and a second bent portion, wherein the first bent portion is bent from and connected to one side of the rotation plate facing a corresponding mounting seat, the second bent portion is connected to one end of the first bent portion facing away from the locking leaf and is bent toward the rotation plate, and a clearance is formed between the second bent portion and the rotation plate.

7. The mounting and demounting structure according to claim 6, wherein the rotation plate comprises a third plate and a fourth plate, wherein the third plate is bent from and connected to the fourth plate, the two connection ears and the resilient sheet are disposed on the third plate, the fourth plate is attached to a corresponding mounting seat, and the two second limiting plates and the locking tab are disposed on the fourth plate.

8. The mounting and demounting structure according to claim 1, further comprising a locking member, wherein the locking member passes through the locking leaf and a corresponding mounting seat and is detachably connected to a corresponding fan blade.

9. The mounting and demounting structure according to claim 1, wherein an inlet edge of the insertion cavity is provided with a guide plate extending in a direction away from the insertion cavity.

10. A fan, comprising a mounting base and the mounting and demounting structure according to claim 1, wherein the mounting and demounting structure is mounted to the mounting base, and a locking leaf is configured to rotate upward or downward relative to a corresponding mounting seat so as to be switched to the unlocked state.

11. The fan according to claim 10, wherein the insertion assembly comprises a first plate and a second plate that are spaced apart, wherein two first limiting plates that are spaced apart protrude from one side of the first plate facing the second plate to one side of the second plate, and two first limiting plates that are spaced apart protrude from one side of second plate facing the first plate to one side of the first plate, two first limiting plates on the first plate are enclosed to form a first limiting groove, two first limiting plates on the second plate are enclosed to form a second limiting groove, and the resilient limiting member comprises a resilient portion and a limiting portion connected to the resilient portion; and wherein a bottom wall of the first limiting groove is provided with a first connection hole, the resilient portion is lodged in the first limiting groove and the second limiting groove, the limiting portion extends out of the first connection hole and engages with the first limiting hole.

12. The fan according to claim 11, wherein the resilient portion comprises a first straight plate, a second straight plate and a first connection plate, wherein the first straight plate is opposite to the second straight plate and connected to the second straight plate through the first connection plate, the limiting portion protrudes from one side of the first straight plate facing away from the second straight plate, one end of the second straight plate facing away from the first connection plate is provided with an engagement portion, a bottom wall of the second limiting groove is provided with a second connection hole, the second straight plate abuts against the bottom wall of the second limiting groove, and the engagement portion is lodged in the second connection hole.

13. The fan according to claim 10, wherein one side of the locking leaf facing the each of the plurality of mounting seats is provided with a resilient sheet, and each of the plurality of mounting seats is provided with a bypassing groove for bypassing the resilient sheet; and when the locking leaf is in the locked state, the resilient sheet passes through the bypassing groove and presses against a respective one of the plurality of fan blades.

14. The fan according to claim 13, wherein the locking leaf comprises two connection ears, two second limiting plates and a rotation plate, wherein the two connection ears are oppositely disposed at a first end of the rotation plate and are rotatably connected to a respective mounting seat, and the two second limiting plates are oppositely disposed at a second end of the rotation plate; and when the locking leaf is in the locked state, the two second limiting plates are respectively stacked on two opposite sides of a corresponding mounting seats, a limiting protrusion is disposed on one of one second limiting plate and a corresponding one of the plurality of mounting seats, and a second limiting hole is disposed on another one of the one second limiting plate and the corresponding one of the plurality of mounting seats, wherein the limiting protrusion engages with the second limiting hole.

15. The fan according to claim 14, wherein the locking leaf is provided with a cutout, and the locking tab is bent out from the cutout; and the resilient sheet comprises a first bent portion and a second bent portion, wherein the first bent portion is bent from and connected to one side of the rotation plate facing a corresponding mounting seat, the second bent portion is connected to one end of the first bent portion facing away from the locking leaf and is bent toward the rotation plate, and a clearance is formed between the second bent portion and the rotation plate.

16. The fan according to claim 15, wherein the rotation plate comprises a third plate and a fourth plate, wherein the third plate is bent from and connected to the fourth plate, the two connection ears and the resilient sheet are disposed on the third plate, the fourth plate is attached to a corresponding mounting seat, and the two second limiting plates and the locking tab are disposed on the fourth plate.

17. The fan according to claim 10, wherein the mounting and demounting structure comprises a locking member, wherein the locking member passes through the locking leaf and a corresponding mounting seat and is detachably connected to a corresponding fan blade.

18. The fan according to claim 10, wherein an inlet edge of the insertion cavity is provided with a guide plate extending in a direction away from the insertion cavity.

* * * * *